US008661866B2

(12) United States Patent
Mitsukawa et al.

(10) Patent No.: US 8,661,866 B2
(45) Date of Patent: Mar. 4, 2014

(54) APPARATUS FOR PRODUCING A FLAT TUBE AND METHOD OF PRODUCING A FLAT TUBE

(75) Inventors: Kazuhiro Mitsukawa, Ichinomiya (JP); Shigenari Takigiri, Kariya (JP); Shigenobu Furukawa, Tokai (JP)

(73) Assignee: Denso Corporation, Kariya (JP)

( * ) Notice: Subject to any disclaimer, the term of this patent is extended or adjusted under 35 U.S.C. 154(b) by 323 days.

(21) Appl. No.: 12/982,074

(22) Filed: Dec. 30, 2010

(65) Prior Publication Data

US 2011/0179845 A1 Jul. 28, 2011

(30) Foreign Application Priority Data

Jan. 25, 2010 (JP) ..... 2010-013364

(51) Int. Cl.
*B21D 5/14* (2006.01)
*B21D 5/08* (2006.01)

(52) U.S. Cl.
USPC ..... 72/179; 72/181

(58) Field of Classification Search
USPC ..... 72/176, 177, 179, 181, 367.1, 368, 178, 72/182, 252.5, 365.2, 366.2; 29/890.053
See application file for complete search history.

(56) References Cited

U.S. PATENT DOCUMENTS

| | | | | |
|---|---|---|---|---|
| 4,595,135 | A * | 6/1986 | Wallis | 72/181 |
| 4,658,584 | A | 4/1987 | Suzuki et al. | |
| 5,875,668 | A | 3/1999 | Kobayashi et al. | |
| 5,876,668 | A * | 3/1999 | Kawashima et al. | 422/64 |
| 6,131,431 | A | 10/2000 | Ona | |
| 2007/0240473 | A1 * | 10/2007 | Taniyama | 72/181 |

FOREIGN PATENT DOCUMENTS

| | | |
|---|---|---|
| JP | B-47-14492 | 5/1972 |
| JP | A-60-199767 | 10/1985 |
| JP | A-8-103818 | 4/1996 |
| JP | A-10-137842 | 5/1998 |
| JP | A-10-272513 | 10/1998 |

OTHER PUBLICATIONS

Japanese Office Action dated Nov. 15, 2011 issued in Japanese Application No. 2010-013364 (with translation).
Mar. 20, 2013 Office Action issued in Chinese Patent Application No. 201110052647 (with translation).

* cited by examiner

*Primary Examiner* — Teresa M Ekiert
(74) *Attorney, Agent, or Firm* — Oliff PLC

(57) ABSTRACT

A method of producing a flat tube T by bending a band-like material M to be worked, wherein the material M to be worked is pre-bent to form a pre-formed groove Md in the material M along the longitudinal center axis thereof. Thereafter, the material M to be worked is gradually moved so that both edge portions of the material M to be worked in the lengthwise direction thereof gradually approach each other with the pre-formed groove Md as a center to form a tubular shape.

4 Claims, 5 Drawing Sheets

APPARATUS FOR PRODUCING A FLAT TUBE AND METHOD OF PRODUCING A FLAT TUBE

BACKGROUND OF THE INVENTION

1. Technical Field of the Invention

This invention relates to an apparatus for producing a flat tube, in which a material to be worked into a desired shape is gradually formed so as to eliminate defective forming, such as buckling and the like of the material being worked, and in particular, for producing a tube through which a fluid flows to exchange heat in a heat exchanger, such as a vehicle radiator and a hot water-type heating apparatus. The invention, further, relates to a method of producing the flat tube.

2. Description of the Related Art

A pipe-forming method has heretofore been known for forming a thin sheet metal material into a pipe based on a plastic working method. As the pipe-forming method, it is a generally accepted to employ a continuous roll forming process as described below from the standpoint of productivity.

For instance, JP-A-10-272513 discloses a method of producing a pipe by using a pipe producing apparatus, wherein a band-like material having high spring-back characteristics is deformed into the shape of a pipe, the deformed pipe is wound in the form of a flat plate and is easily unwound to form a pipe.

JP-A-10-137842 discloses an apparatus for continuously producing a thin pipe, comprising a pre-bending roller, a subsequent pair of patches for executing the forming from a bent shape into a U-shape, and another subsequent pair of patches for executing the forming from the U-shape into a C-shape, which are arranged on both the right and left sides of the band-like blank so that the pre-bent band-like blank is gradually made from the U-shape into the C-shape in cross section as it passes through the right and left patches.

Further, JP-A-8-103818 discloses a method of continuously producing a tapered pipe by passing a blank coil between a plurality of pairs of pipe-forming rollers, wherein settings of the pipe-forming apparatus having the pipe-forming rollers are varied depending upon a change in the width of the blank coil that passes through the pipe-forming rollers.

SUMMARY OF THE INVENTION

Heat exchangers, such as vehicle radiators and hot water-type heating apparatuses are constituted by using a flat tube for flowing a fluid for exchanging heat.

The flat tube is produced by bending the material along the longitudinal center axis thereof while curving both edges thereof in the lengthwise direction so as to face each other at a small curvature, and bringing both edges into engagement so as to be overlapped to thereby form the tube having a tubular shape in cross section by rolls.

Generally, in the roll forming process, dedicated rolls are installed on a number of roll stands in order to prevent buckling/warping of the material, and the forming is gradually conducted. Therefore, many drive/transmission devices are necessary arousing such problems as complicated facility and an increase in the time for the preparatory plan of the rolls.

On the other hand, a method has been proposed to simplify the facility by omitting the drive/transmission devices and forming a fixed shoe that is widely utilizable.

In this case, in order to suppress the elongation of the material being worked that results in defective forming (warping, buckling), a draw-working method is employed in which the material to be worked is gradually bent by being fed into one side of a tool that forms the material into a desired shape while drawing the material from the other side of the tool so that the material to be worked is passed therethrough.

However, when the draw-working method is conducted by using the above tool, an increase in the drawing load to attain drawing results in an abnormal increase in the resistance force of the material being worked as it passes through the tool. Namely, the material being worked cannot be smoothly passed through the tool. In addition, the material that is continuously fed to the tool in a predetermined amount often tends to buckle in front of the tool.

In order to employ the continuous roll forming process by using the tool as taught by the above JP-A-10-272513, JP-A-10-137842 and JP-A-8-103818, therefore, the material must be drawn by using tension rolls to lower the drawing load.

In the production site where many kinds of products are produced, further, it is necessary to additionally install dedicated stands and dedicated rolls for each of the sizes and standards of the products.

Therefore, there and problems such as an extended period of time for the preparatory plan and an increase in the scale of the facility for additionally installing stands to meet the products of different sizes.

The present invention has been proposed due to the above circumstances and its object is to provide an apparatus for producing a flat tube, and in particular, for producing a tube used in the heat exchangers such as radiators for vehicles and hot water-type heating apparatuses, by effecting the pre-bending to lower the drawing load, by improving the tool to eliminate factors that cause defective forming such as buckling of the material to realize the continuous roll forming, and shortening the time for the preparatory plan and suppressing an increase in the scale of the facility. The invention, further, provides a method of producing the flat tube.

In order to solve the above problems according to a first aspect of the present invention, the apparatus for producing a flat tube comprises a material feed unit (2) for feeding a band-like material (M) to be worked that is wound like a roll; a tool unit (3) for bending the material (M) to be worked fed from the material feed unit (2); a tension roller unit (4) for drawing the material (M) to be worked from the tool unit (3) so that the material (M) to be worked is gradually bent by drawing through the tool unit (3), and for finish correcting the material (M) to be worked that is bent while drawing the material (M) to be worked; and a delivery roller unit (5) for delivering a worked product in the form of a flat tube (T) from the tension roller unit (4); wherein the material feed unit (2) on the upstream of the tool unit (3) is provided with pre-bending means for forming a pre-formed groove (Md) in the material (M) to be worked along the longitudinal center axis thereof by pre-bending.

As described above, the material (M) to be worked is pre-bent along the longitudinal center axis thereof. Therefore, the load of angle bending in the subsequent bend forming can be decreased to decrease the drawing load making it possible to continuously obtain a bend-worked product of a desired shape maintaining high precision while eliminating factors that cause defective forming such as buckling of the material, etc.

According to a second aspect of the invention, the material feed unit (2) has at least a pair of rollers (21), and the pair of rollers (21) has the pre-bending means.

Upon passing the material (M) to be worked through the pair of rolls (21) of the material feed unit (2), therefore, the material (M) to be worked is pre-bent along the longitudinal center axis thereof, and a desired bending is achieved by the tool unit (3) on the downstream side.

According to a third aspect of the invention, on the downstream of the material feed unit (2), the tool unit (3) comprises a receiving tool (32) having a recessed guide portion (32*g*) for receiving the pre-formed groove (Md) of the material (M) to be worked along the longitudinal center axis thereof fed from the material feed unit (2); a forming shoe (33) for pushing the material (M) to be worked onto the recessed guide portion (32*g*) in the receiving tool (32) to prevent the material from rising due to the spring back thereof, and for promoting the bending; and a plurality of pairs of shape-forming members (34) arranged in pairs so as to be opposed to each other in a direction at right angles with a direction in which the material (M) to be worked is transferred in a manner that the opposing gaps between the pair members (34) are gradually narrowed toward the downstream side.

Thus, the material (M) that is pre-bent through the material feed unit (2) is caused to pass through the tool unit (3) due to the tension roller unit (4) and the delivery roller unit (5) on the downstream side. Upon effecting the pre-bending as described above, the end of the material is not deformed even by using the tool unit (3) which has no moving power by itself, and the material is continuously drawn by the tension roller unit (4) and the delivery roller unit (5).

At the time of passing through the tool unit (3), the pre-formed groove (Md) of the material (M) to be worked is brought to the recessed guide portion (32*g*) in the receiving tool (32) along the direction in which the material (M) to be worked is transferred.

At this moment, the forming shoe (33) pushes the material (M) to be worked onto the recessed guide portion (32*g*) in the receiving tool (32) and prevents the material (M) from rising due to the spring back thereof. The material (M) to be worked, further, travels along the receiving tool (32) and, therefore, passes through the plurality of pairs of shape-forming members (34) that are arranged in a manner that the gaps thereof gradually narrows. Thus, the material (M) to be worked is gradually bent so that the edges on both sides thereof in the lengthwise direction gradually approach each other.

According to a fourth aspect of the invention, the tension roller unit (4) for finish correction has protruded and recessed correction portions (42) for removing work strain occurred in the material (M) to be worked due to the pre-bending.

After the desired bending is finished through the tool unit (3), therefore, the material is simply passed through the tension roller unit (4) whereby the work strain caused by the pre-bending is effectively corrected and removed by the convex correction portion (42) of the tension roller unit (4).

According to a fifth aspect of the invention, the shape-forming members (34) may be so constituted that the gaps therebetween are adjustable in a direction at right angles with the direction in which the material (M) to be worked is transferred.

Therefore, differently worked products can be obtained by simply varying the gaps of the shape-forming members (34) depending on the sizes of the products to be worked.

A sixth aspect of the invention is concerned to a method of producing a flat tube (T) by bending a band-like material (M) to be worked comprising the steps of: pre-bending to form a pre-formed groove (Md) in the material (M) to be worked along the longitudinal center axis thereof while feeding the material (M) to be worked along the longitudinal center axis thereof; bending the material (M) to be worked around the pre-formed groove (Md) while drawing the material (M) to be worked from the downstream side in the direction in which the material (M) to be worked is transferred; and removing a work strain that has occurred in the step of pre-bending while the material (M) to be worked is being drawn from the downstream side in the direction in which the material (M) to be worked is transferred.

Thus, the material (M) to be worked is pre-bent along the longitudinal center axis thereof. Therefore, the load of angle bending in the subsequent bend forming can be decreased to decrease the drawing load making it possible to continuously obtain a product bent into a desired shape maintaining high precision while eliminating factors that cause defective forming, such as buckling of the material, etc.

Reference numerals in parentheses of the above-mentioned means represent correspondence to concrete means described in the embodiments below.

The present invention may be more fully understood from the description of preferred embodiments of the invention as set forth below together with the accompanying drawings.

DESCRIPTION OF THE PREFERRED EMBODIMENTS

Prior to describing an embodiment of the apparatus for producing a flat tube of the present invention, described below is an apparatus 100 for producing a flat tube according to a related art shown in FIG. 5 to clarify means that overcomes the problems of the invention.

The apparatus 100 for producing the flat tube uses a thin band-like metal that easily undergoes plastic deformation as an object that is to be bent.

The band-like metal is presumed to be a suitable material having a relatively small specific gravity and very flexible, plastic deformability and malleability (e.g., light metal sheet such as of aluminum).

The product to be produced is presumed to be a flat tube for flowing a fluid for exchanging the heat that is used in heat exchangers, such as radiators for automotive engines and hot water-type heating apparatuses.

Figure 5:
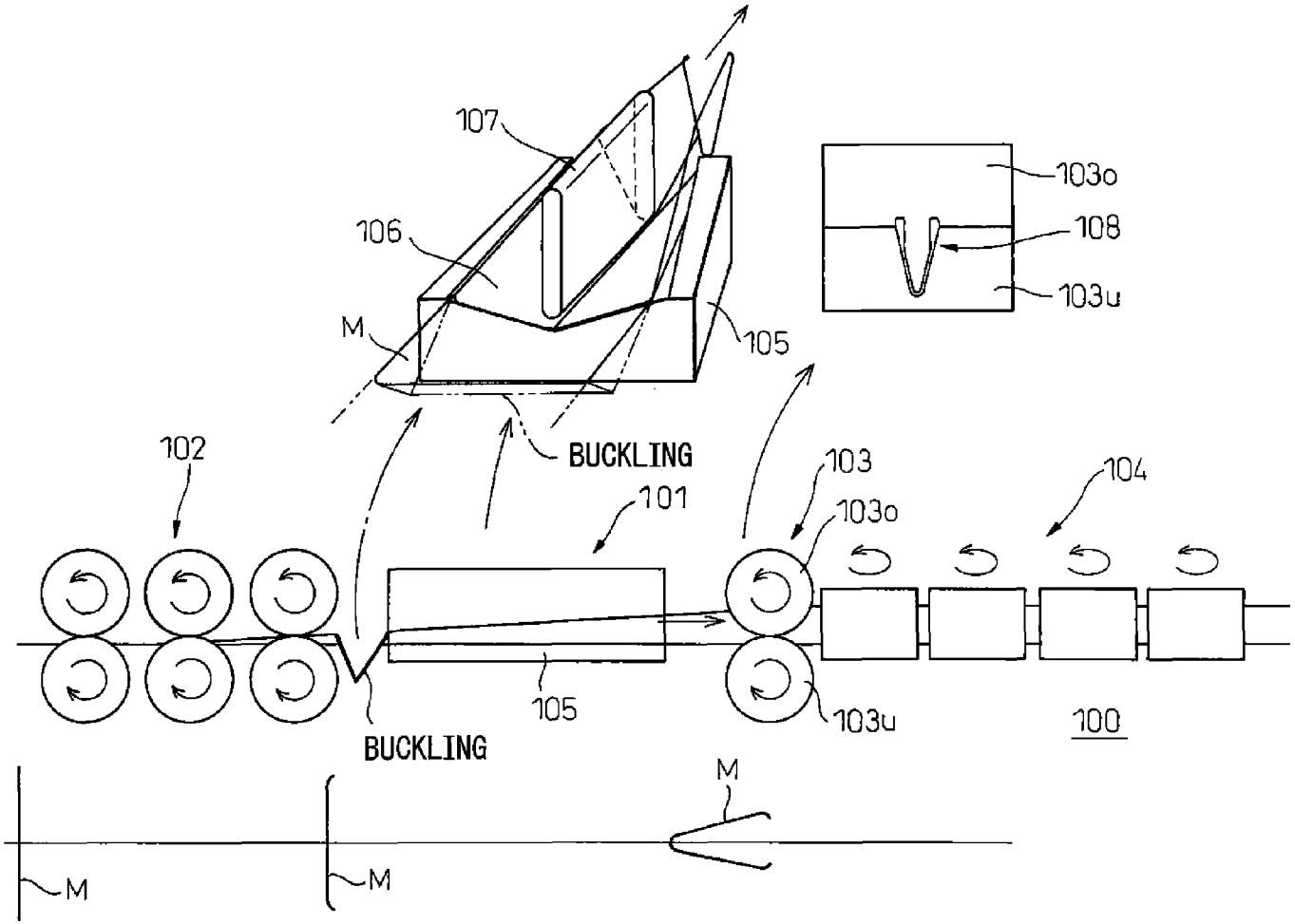
Fig.5 Related Art
FIG. 5 is a view including a schematic perspective view of an apparatus for producing a flat tube and a tool and, further, illustrating a state of working in time series according to a related art for comparison with the present invention.

The apparatus 100 for producing the flat tube is a continuous roll forming system using a tool 101 that executes the bending as shown in FIG. 5. The material M to be worked is fed by a material feed unit 102 to the tool 101.

The material M to be worked is fed to the tool 101, is drawn from the tool 101 by a tension roller unit 103 arranged downstream of the tool 101, and is gradually bent about the longitudinal center axis thereof. Further, a delivery roller unit 104 is arranged on the downstream of the tension roller unit 103 to deliver a worked product in the form of a flat tube T.

Figure 2:
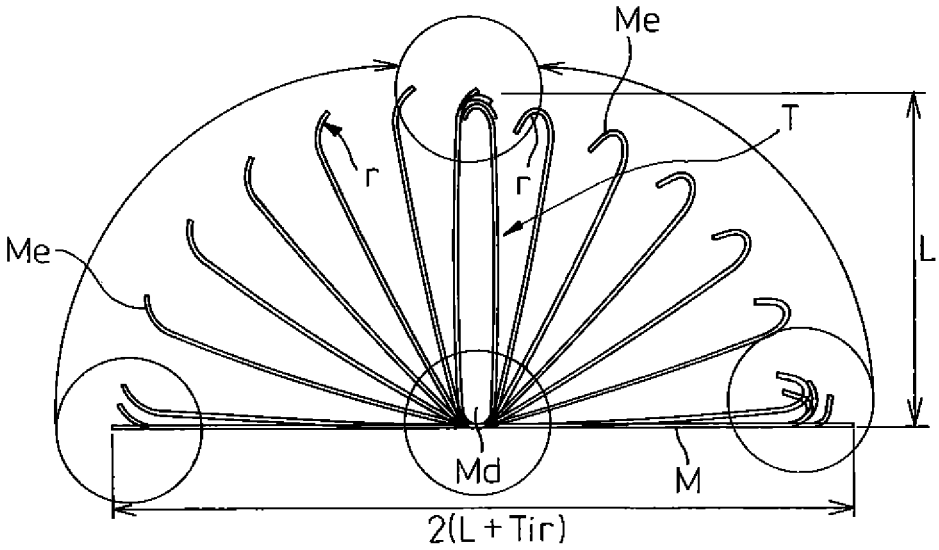
FIG. 2 is a sectional view showing the flat tube produced by the apparatus for producing the flat tube shown in FIG. 1, and a state of working the flat tube.

By taking the width L of the flat tube T, the thickness and the overlapped width (radius r of curvature) at both edge portions for brazing into consideration, the material M to be worked has a width of about $2(L+\pi r)$ (see FIG. 2).

The tool 101 is equipped with a working bedplate 105 that gradually bends the material M to be worked that is fed about the longitudinal center axis thereof as the material M to be worked is moved by the material feed unit 102 and the tension roller unit 103 serving as power sources.

The working bedplate 105 has a V-shaped forming groove 106 formed in the upper surface thereof and of which the width gradually decreases and the tilting angle increases from the side of receiving the material M to be worked toward the drawing side thereof in the direction in which the material M to be worked is transferred. The lowest portion of the V-shaped forming groove 106 goes along the center axis in the direction of transfer. When the material M to be worked is transferred, a shoe 7 pushes the material M to be worked from the upper side toward the center axis of transfer.

The tension roller unit 103 comprises a pair of roller members 103*o* and 103*u* that are press-contacted to each other up and down. The roller members 103*o* and 103*u* have protruded and recessed holding portions 108 formed on and in the press-contacting surfaces thereof for holding and drawing the material M to be worked.

According to the production method by using the above apparatus 100 for producing the flat tube, the material M to be worked fed from the material feed unit 102 is delivered onto the working bedplate 105 of the tool 101 in a state where both side edge portions thereof in the lengthwise direction are slightly bent upward. The material M to be worked is delivered maintaining its initial width. In order to pass the material M to be worked through the working bedplate 105 having the V-shaped forming groove 106 of which the width gradually decreases and the tilting angle increases, therefore, the material M to be worked must be drawn from the side of the tension roller unit 103 on the downstream side with a considerably large tensile force overcoming the frictional force caused by the angle bending force required for the bend forming.

While the material M to be worked is passing through the working bedplate 105, the shoe 107 is lowered from the upper side toward the center axis of transfer to push the material M to be worked onto the working bedplate 105.

Figure 6A:
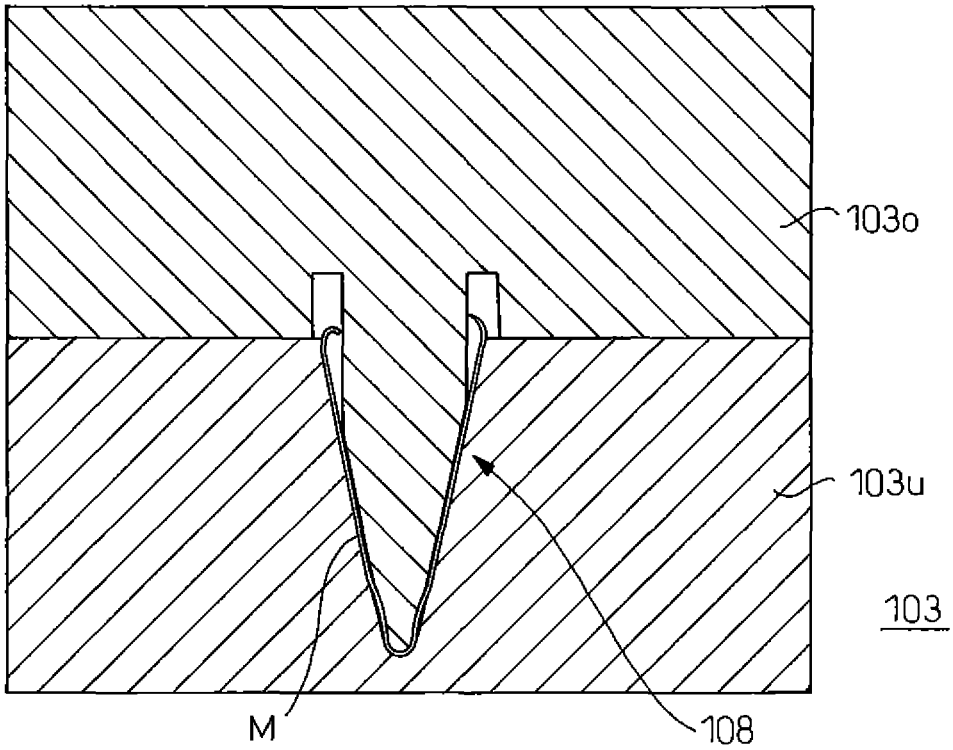
Fig.6a Related Art
FIG. 6*a* is a sectional view illustrating a major portion of the tension roller unit immediately after the angle bending by using the tool in the apparatus for producing the flat tube shown in FIG. 5.

Being passed through the tool 101 in the above state, the material M to be worked is bent about the longitudinal center axis thereof to a nearly sufficient degree, delivered to the tension roller unit 103, and is held by the protruded and recessed holding portions 108 on and in the press-contacting surfaces of the roller members 103*o* and 103*u* (FIG. 6*a*). Due to the power source of the tension roller unit 103, the material M to be worked is drawn and is bent.

Figure 6B:
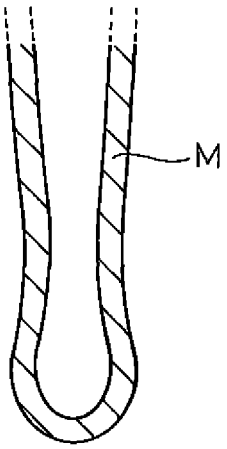
Fig.6b Related Art
FIG. 6*b* is a sectional view of a major portion of the flat tube that has passed through the tension roller unit shown in FIG. 6*a*.

After having passed through the tension roller unit 103, the side surfaces near the center of the bend of the material M tend to be slightly recessed inward as shown in FIG. 6*b* since the tension roller unit 103 has not been provided with any correction means.

To realize the bending by passing the material M to be worked through the tool 101, a considerably large drawing force or tensile force is necessary to overcome the frictional force caused by the angle bending force required for the bend forming. Namely, the tensile force must be produced by the tension roller unit 103 which is the power source based on a holding force or frictional force of rolls created by the protruded and recessed holding portions 108 on and in the press-contacting surfaces of the roller members 103*o* and 103*u*. If the bending is not accomplished by the tensile force created by the frictional force of the rolls of the tension roller unit 103 while the material M to be worked is being passed, then the continuous bending cannot be attained by using the apparatus 100 for producing the flat tube; i.e., the material M to be worked is buckled which is a factor of defective forming from the material feed unit 102 up to the tool 101.

In order to realize the continuous bending relying only upon the tensile force of the tension roller unit 103, therefore, it becomes necessary to lower the passage resistance at the time of passing the material M to be worked therethrough while bending it, i.e., to lower the drawing load.

The drawing load can be effectively lowered if the material M to be worked is pre-bent before the tool as proposed by the present invention.

In addition, to work different products by using the working bedplate 105 of the tool 101, it is necessary to replace the stands, dedicated rolls and the working bedplate by the corresponding ones from the standpoint of the drawing load and the shape.

Therefore, the above apparatus 100 for producing the flat tube cannot be used for producing products of different working sizes. Therefore, dedicated stands and dedicated rolls must be additionally provided for each of the sizes and standards of the products requiring an extended period of time for the preparatory plan or resulting in the facility being large in size due to the additional provision of the stands for the products of different sizes.

Figure 1:
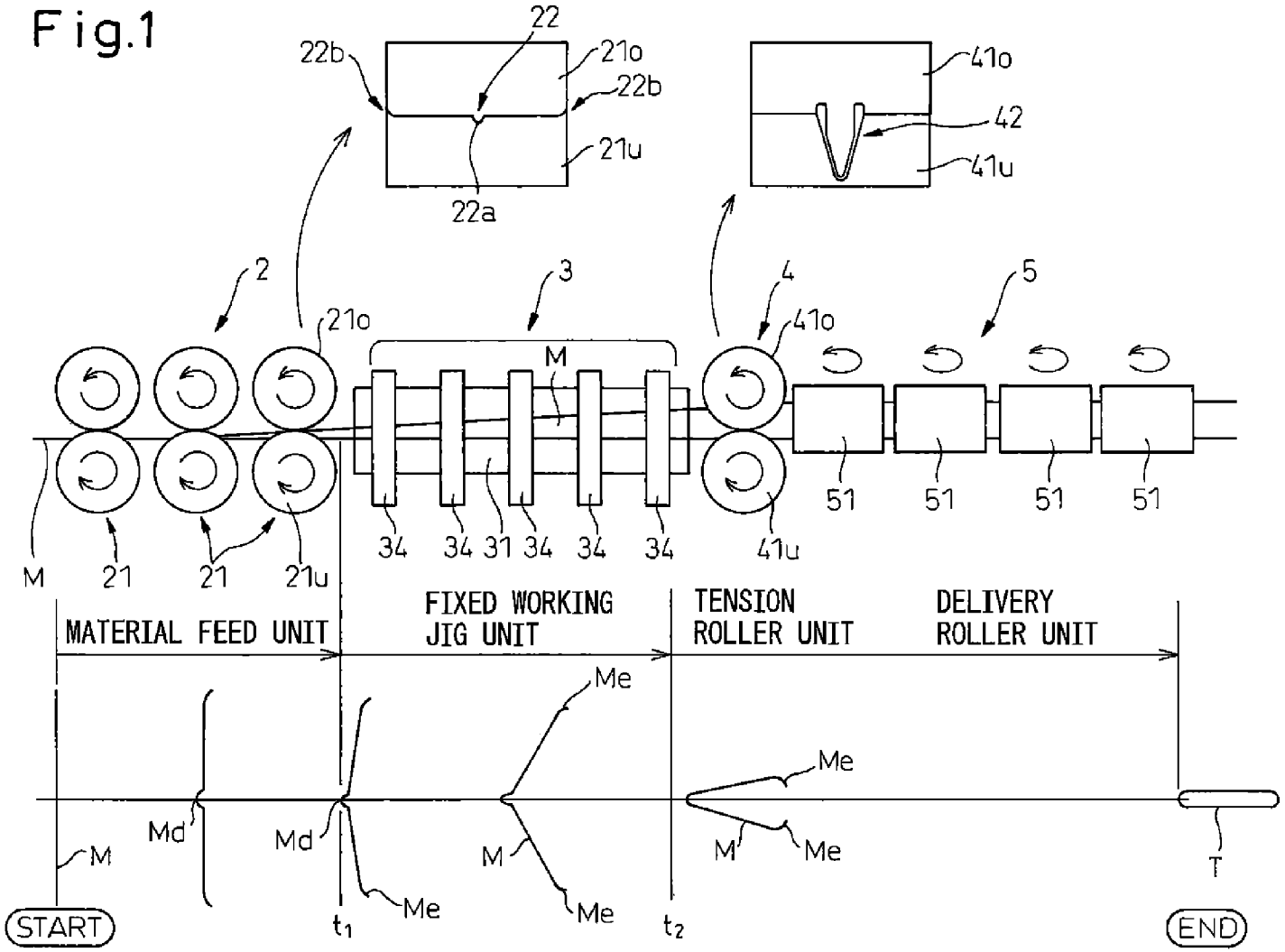
FIG. 1 is a diagram schematically illustrating a first embodiment of the entire apparatus for producing a flat tube, used for executing the working procedure of the method of producing a flat tube according to the present invention, and the state of working in time series.

Next, described below with reference to FIG. 1 is an embodiment of the apparatus for producing a flat tube according to the present invention. Like in the above related technology, the material M to be worked is a thin band-like metal that easily undergoes plastic deformation, and the product to be produced is presumed to be a flat tube T for heat exchangers, such as automotive engine radiators and hot water-type heating apparatuses.

An apparatus 1 for producing a flat tube comprises a material feed unit 2 for feeding a band-like material (M) to be worked that is wound like a roll; a tool unit 3 for bending the material M to be worked fed from the material feed unit 2; a tension roller unit 4 for drawing the material M to be worked from the tool unit 3 so that the material M to be worked is gradually bent by drawing through the tool unit 3, and for finish-correcting the material M to be worked that is bent while drawing the material M to be worked; and a delivery roller unit 5 for delivering a worked product in the form of a flat tube T from the tension roller unit 4.

The material feed unit 2 includes a plurality of upper and lower rollers 21*o* and 21*u* constituting pairs of rollers 21 up and down to rotate in opposite directions upon contacting to each other along the production line of the apparatus 1 for producing the flat tube. These pairs of rollers 21 are rotated by predetermined power sources and power mechanisms (not shown).

In order to pre-bend the material M to be worked, the upper and lower rollers 21*o*, 21*u* that rotate in opposite directions upon coming in contact with each other forming the pairs of rollers 21, are forming, in their surfaces, portions that go along the longitudinal center axis of the material M to be worked that is fed as well as portions corresponding to both side edge portions thereof as pre-bending means 22 that mesh in a protruded/recessed manner. The pre-bending means 22 comprises protruded and recessed portions 22*a* for imparting, to the material M to be worked, a pre-formed groove Md along the longitudinal center axis, and R-imparting portions 22*b* for imparting, to the material M to be worked, R-portions Me that are brazing areas at both side edge portions, the protruded and recessed portions 22*a* as well as the R-imparting portions 22*a* being formed in the contacting surfaces of the pair of rollers 21 just before the tool unit 3. Upon gradually pre-bending the material M to be worked as described above, the plastic deformation is promoted against the restoring force of the material M to be worked, pre-bending is achieved, and predetermined pre-formed groove Md and R-portions Me are formed in the material M to be worked.

Next, the tool unit 3 will be described with reference to FIGS. 1 and 3.

The tool unit 3 has a receiving tool 32 that is fixed to a bedplate 31 and extends in a direction in which the material M to be worked is transferred. On the downstream of the material feed unit 2, the receiving tool 32 receives the material M to be worked via the pre-formed groove Md. In FIG. 3, the bedplate 31 is not shown.

Figure 3:
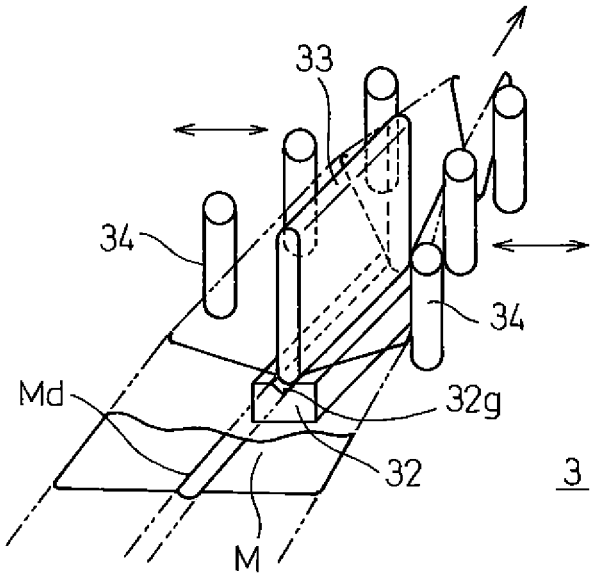
FIG. 3 is a schematic perspective view of a tool unit for effecting the angle bending in the whole apparatus for producing the flat tube shown in FIG. 1.

In this case, the receiving tool 32 is provided with a recessed guide portion 32*g* for receiving the pre-formed groove Md along the longitudinal center axis of the material M to be worked that is fed by the material feed unit 2 (see FIG. 3).

The tool unit 3 is further provided with a forming shoe 33 which pushes the conveyed material M to be worked onto the recessed guide portion 32*g* in the receiving tool 32 to prevent the material M from rising due to the spring back thereof and to promote the bending.

The tool unit 3, further, has, on both sides of the bedplate 31 that supports the receiving tool 32, a plurality of pairs of shape-forming roller members 34 arranged in pairs so as to be opposed to each other in a direction at right angles with the direction in which the material M to be worked is transferred, the plurality of pairs of shape-forming roller members 34 being so arranged that the opposing gaps between the pair members 34 are gradually narrowed toward the downstream side.

The gaps between the thus arranged roller members can be adjusted by a predetermined mechanism that is not shown depending upon the products to be bent. Further, the shape-forming roller members 34 are provided having different diameters, and can also be replaced by the ones having different diameters depending upon the products to be bent.

Next, the tension roller unit 4 is shown in FIG. 4*a* on an enlarged scale. The tension roller unit 4 comprises a pair of roller members 41*o* and 41*u* that are press-contacted to each other up and down. These roller members 41*o* and 41*u* are provided with protruded and recessed holding portions 42 formed on and in the press-contacting surfaces thereof for holding and drawing, in a press-contacted state, the material M to be worked to a nearly sufficient degree by the tool unit 3. As shown in FIG. 4*a*, the protruded and recessed holding portions 42 are provided with convex correction portions 43 near the end of the protruded holding portion 42*a* to correct and remove the work strain that has occurred due to the pre-bending.

The delivery roller unit 5 comprises a plurality of pairs of rollers 51. The material M to be worked is bent through the tool unit 3, finish corrected through the tension roller unit 4, and is drawn by the pairs of rollers 51 in a manner of being held from both sides thereof. Finally, the R-portions Me at both edge portions of the material M to be worked are overlapped one upon the other, and the material M to be worked is delivered as the worked product in the form of a flat tube T.

In the foregoing was described the apparatus 1 for producing a flat tube of the invention. Next, a procedure of producing the flat tube T will be described with reference to the state of working in time series at every portion of the apparatus 1 for producing the flat tube shown in FIG. 1.

First, the band-like material M to be worked that is wound like a roll is drawn at its leading end toward the tension roller unit 4 by a suitable pulling means. The pairs of feed rollers 21 in the material feed unit 2 are rotated by a predetermined power source and a drive mechanism so that the material M to be worked held between the upper and lower rollers 21*o*, 21*u* is fed toward the tool unit 3.

While passing through the pairs of feed rollers 21 in the material feed unit 2, the material M to be worked is imparted with a plastic deforming force against its restoring force along both edge portions and along the longitudinal center axis thereof, and is gradually pre-bent. Upon passing through the upper and lower rollers 21*o*, 21*u* of the pair of rollers 21 just before the tool unit 3, the material M to be worked is imparted with a predetermined pre-formed groove Md along the longitudinal center axis thereof due to the protruded and recessed portions 22 of the upper and lower rollers 21*o* and 21*u*, and is, further, imparted with R-portions Me which are the brazing areas at both edge portions thereof due to the R-imparting portions 22*b*.

As described above, the material M to be worked that is fed by the material feed unit 2 is imparted with the pre-formed groove Md along the longitudinal center axis thereof, imparted with the R-portions Me which are the brazing areas at its both edge portions, and is pre-bent in such a state that both edge portions thereof are slightly bent upward around the pre-formed groove Md (point t1 in FIG. 1).

With the material M to be worked being brought to the tool unit 3 in the above state, the receiving tool 32 fixed to the bedplate 31 receives the material M to be worked at the recessed guide portion 32*g* via the pre-formed groove Md.

Next, upon being pulled toward the tension roller unit 4, the material M to be worked passes through the shape-forming roller members 34 arranged in a plural number on both sides of the bedplate 31 that supports the receiving tool 32. The shape-forming roller members 34 are so arranged that the opposing gaps between the pair members 34 are gradually narrowed toward the downstream side. While being transferred toward the downstream side, therefore, the material M to be worked receives a pushing force toward the inside in the direction of width from the shape-forming roller members 34 on both sides of the bedplate 31. Due to its spring back, the material M to be worked tends to rise from the recessed guide portion 32*g* of the receiving tool 32 fixed to the bedplate 31.

However, the forming shoe 33 descends toward the recessed guide portion 32*g* in the receiving tool 32 to push the material M to be worked that is conveyed. Therefore, the material M to be worked is prevented from rising and is favorably bent.

Upon traveling through the tool unit 3 as described above, the material M to be worked is bent to a nearly sufficient degree (point t2 in FIG. 1) and is held by the protruded and recessed holding portions 42 on and in the press-contacting surfaces of the roller members 41*o*, 41*u* in the tension roller unit 4 on the downstream of the tool unit 3. Thereafter, due to the power source of the tension roller unit 4, the material M to be worked is fed to the delivery roller unit 5 in a state of being held by the roller members 41*o* and 41*u*.

Figure 4:
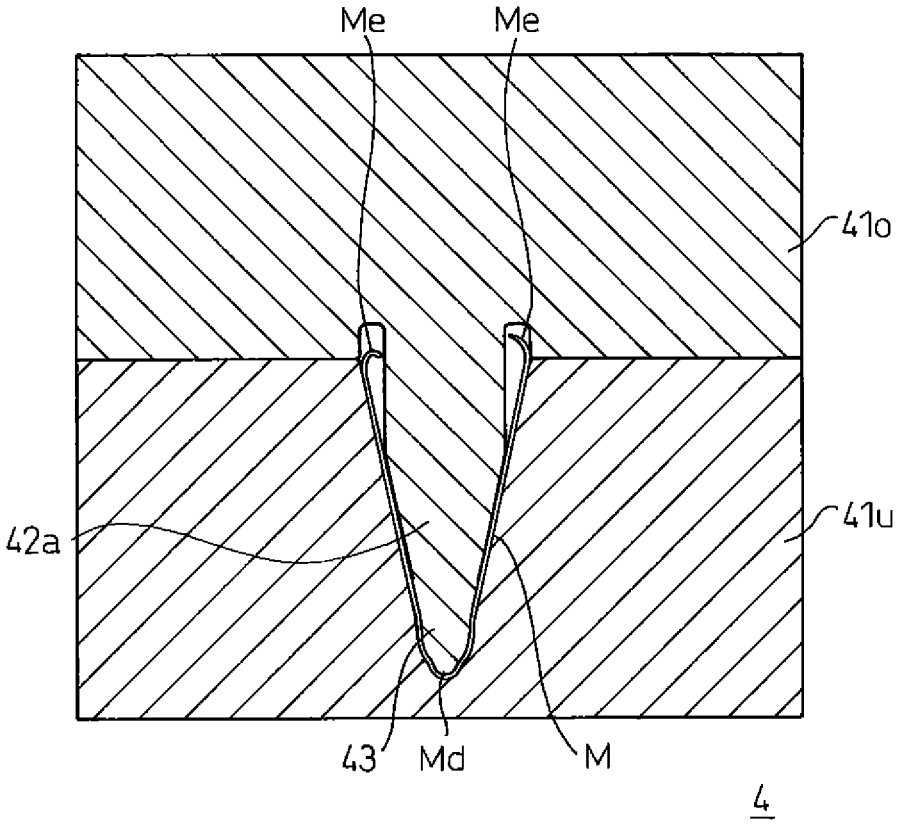
FIG. 4 is a sectional view illustrating a major portion of a tension roller unit for executing the finish correction immediately after the angle bending by using the tool unit shown in FIG. 3.

At the time when the material M to be worked passes through the protruded and recessed holding portions 42 of the press-contacting surfaces of the roller members 41*o* and 41*u* in the tension roller unit 4, the work strain caused by the pre-bending is corrected and removed by the convex correction portions 43 near the end of the protruded holding portion 42*a* (see FIG. 4).

In the delivery roller unit 5, the material M to be worked that is finish corrected by the tension roller unit 4 is drawn by the plurality of pairs of rollers 51 while being held from both sides thereof. The R-portions Me at both edge portions of the material M to be worked are finally overlapped one upon the other, and the material M to be worked is delivered as the worked product in the form of a flat tube T.

According to the apparatus 1 for producing the flat tube of the present invention as described above, the material M to be worked is gradually pre-bent making it possible to decrease the force of angle bending required for the subsequent bend forming and to decrease the drawing load. Thus, bend-worked products of a desired shape can be obtained maintaining high precision and continuously while eliminating factors that cause defective forming such as buckling of the material, etc.

The gaps of the shape-forming roller members 34 in the tool unit 3 can be varied depending upon the sizes of the products to be worked, and it is possible to obtain products of different sizes while shortening the time for the preparatory plan and suppressing the size of the facility.

Further, the shape-forming roller members 34 are arranged permitting the roller members of different diameters to be replaced. Therefore, the products of different sizes can be easily obtained by simply replacing roller members of different sizes.

While the invention has been described by reference to specific embodiments chosen for purposes of illustration, it should be apparent that numerous modifications could be made thereto by those skilled in the art without departing from the basic concept and scope of the invention.

The invention claimed is:

1. An apparatus for producing a flat tube comprising:

a material feed unit configured to feed a material to be worked;

a tool unit configured to bend said material to be worked fed from said material feed unit;

a tension roller unit configured to draw said material to be worked from said tool unit so that said material to be worked is gradually bent by drawing through said tool unit, and for finish correcting said material to be worked that is bent while drawing said material to be worked; and a delivery roller unit configured to deliver a worked product in the form of a flat tube from said tension roller unit;

wherein said material feed unit on the upstream of said tool unit is provided with pre-bending means for forming a pre-formed groove in said material to be worked along the longitudinal center axis thereof by pre-bending, wherein the tool unit is configured to bend the material around the pre-formed groove, and wherein said tension roller unit for finish correction has protruded and recessed correction portions for removing work strain occurred in said material to be worked due to the pre-bending, wherein the protruded correction portion is provided with convex correction portions near the end thereof.

2. The apparatus for producing a flat tube according to claim 1, wherein said material feed unit has at least a pair of rollers, and said pair of rollers has said pre-bending means.

3. The apparatus for producing a flat tube according to claim 1, wherein, on the downstream of said material feed unit, said tool unit comprises:

a receiving tool having a recessed guide portion for receiving the pre-formed groove of the material to be worked along the longitudinal center axis thereof fed from said material feed unit;

a forming shoe for pushing said material to be worked onto said recessed guide portion in said receiving tool to prevent the material from rising due to the spring back thereof, and for promoting the bending; and a plurality of pairs of shape-forming members arranged in pairs so as to be opposed to each other in a direction at right angles with a direction in which said material to be worked is transferred in a manner that the opposing gaps between the pair members are gradually narrowed toward the downstream side.

4. The apparatus for producing a flat tube according to claim 3, wherein said shape-forming members are so constituted that the gaps therebetween are adjustable in a direction at right angles with the direction in which said material to be worked is transferred.

* * * * *